United States Patent [19]

Longo

[11] Patent Number: 4,993,611

[45] Date of Patent: Feb. 19, 1991

[54] BEVERAGE CONTAINER SUPPORT

[76] Inventor: Rocco Longo, 485 Garfield Ave., Carnegie, Pa. 15106

[21] Appl. No.: 264,473

[22] Filed: Oct. 28, 1988

[51] Int. Cl.[5] ..... A45F 4/00

[52] U.S. Cl. ..... 224/148; 224/202; 248/311.2; 220/85 H; 403/292; 24/3 B

[58] Field of Search ..... 224/148, 250, 42.46 R, 224/92.45 R, 202, 257; 248/311.2, 318, 339, 102; 220/85 H; 229/904; 403/292, 11; 285/397, 14, 924; 24/3 B, 623, 662; 63/11, 3, DIG. 3; 128/864, 866; 446/450

[56] References Cited

U.S. PATENT DOCUMENTS

| | | | |
|---|---|---|---|
| 2,070,414 | 2/1937 | Snell | 294/31.2 |
| 3,144,230 | 8/1964 | Brooks | 248/102 |
| 3,332,563 | 7/1967 | Reshan | 248/102 |
| 3,365,228 | 1/1968 | Hay | 248/311.2 |
| 3,648,830 | 3/1972 | Graf | 248/311.2 |
| 4,128,356 | 12/1978 | Carlisle | 403/292 |
| 4,135,719 | 1/1979 | Braunhut | 231/2.1 |
| 4,296,902 | 10/1981 | Dachtler | 248/102 |
| 4,511,042 | 4/1985 | Wischusen, III | 229/904 |
| 4,596,370 | 6/1986 | Adkins | 248/311.2 |
| 4,634,089 | 1/1987 | Wright et al. | 248/311.2 |
| 4,750,696 | 6/1988 | Shan-Liang | 248/102 |
| 4,754,903 | 7/1988 | Dennis | 224/148 |
| 4,779,831 | 10/1988 | Anderson | 248/311.2 |
| 4,865,239 | 9/1989 | Timbrook | 224/267 |

*Primary Examiner*—Linda J. Sholl

*Attorney, Agent, or Firm*—Kirkpatrick & Lockhart

[57] ABSTRACT

A support for a beverage container which may be placed around the neck of the user is provided. The support includes an adjustable plastic neck ring consisting of interfitting flexible vented tubing sections. A flexible support member is suspended from the neck ring and includes a first leg and a second perpendicular leg. A serrated hole is provided in the second leg to grip the container while a container stabilizing ring is attached to the first leg.

8 Claims, 2 Drawing Sheets

BEVERAGE CONTAINER SUPPORT

BACKGROUND OF THE INVENTION

1. Field of the Invention

The present invention relates generally to beverage container holders. Specifically, it relates to a supporting device for a beverage container which encircles the neck of the wearer and allows for movable suspension of the container.

2. Description of the Prior Art

Body encircling retaining devices for beverage containers are known in the art. A number of supporting devices for baby bottles which are worn by an adult are available as illustrated by U.S. Pat. No. 3,977,638 issued Aug. 31, 1976 to Woodard, U.S. Pat. No. 3,197,099 issued July 27, 1965 to Doba and U.S. Pat. No. 3,144,230 issued Aug. 11, 1964 to Brooks.

Supports for baby bottles which are worn by the baby are also known. For example, Ronald, U.S. Pat. No. 3,543,976 issued Dec. 1, 1970, discloses a flexible loop which fits around the baby's neck and a strap which may be adjusted using a slide buckle. A bottle is attached at a point along the strap using a slide buckle and a spring snap.

Barville et al., U.S. Pat. No. 4,096,977 issued June 27, 1978, discloses a harness having a flexible member to which is coupled a resilient retaining ring for holding a beverage container. Maillard, U.S. Pat. No. 4,473,907 issued Oct. 2, 1984, discloses a bib with an outward facing vertical slot into which a bottle is inserted. Horizontal straps secure the bottle in the slot. Also, Donahue, U.S. Pat. No. 4,498,613 issued Feb. 12, 1985, discloses a support device for various items wherein a cloth strap fastens around the body of the wearer. A frustoconical loop encircles part of the item to be held and is fastened to the encircling strap by means of a nonextendible band or ribbon.

The designs of the prior art involve complex and time consuming means for fastening the beverage container retaining device to the body of the wearer. The purpose of the present invention is to provide a supporting device to enable young children and physically impaired persons to consume beverages without continually having to grasp the beverage container with their hands. Children and the physically impaired often lack either the patience or capability to remain stationary while a complicated apparatus is fastened to their bodies.

Likewise, children and the handicapped need a device which can securely accommodate a beverage container thereby eliminating the potential for slippage or spillage. A retaining device must be stable and strong enough to withstand the sometimes awkward and clumsy movements of the user.

Accordingly, the need exists for a device which can securely accommodate a beverage container and which can be fastened about the body of the wearer in a quick and simple manner.

SUMMARY OF THE INVENTION

The present invention relates to a retaining device for a beverage container. A semirigid plastic ring is slipped over the head of the wearer and worn loosely around the neck. Such ring is made from two open-ended lengths of plastic tubing. One length of tubing is smaller in diameter than the other so that each end of the smaller tube may fit snugly into the open ends of the larger tube thereby forming a continuous ring. The smaller length of tubing has a small hole in its top surface approximately halfway along its length and an identical hole in its bottom surface so that the two holes are aligned. Following the insertion of one end of the smaller tubing section into the larger tubing, only a slight force is required to urge the other end of the small section into the larger because air escape ports are provided.

A support member which may comprise a flap made of a thin flexible material is attached to the neck ring by looping one narrowed end over the ring and securing it by any well known fastening means. This flexible flap also includes a central portion and a widened circular end capable of receiving and retaining a beverage container. The flap is partially sliced between the central portion and circular end to create a hinge. The widened end of the flap may be bent at a 90° angle to the rest of the flap and has a serrated resilient opening which is slightly smaller in diameter than the container to be held. Upon insertion of the container, this opening expands slightly due to the elasticity of the flap material to accommodate and securely hold the container.

A ring made of flexible plastic tubing is fastened to the flap so that it extends parallel to the widened portion of the flap. This ring is slightly larger in diameter than the container to be held. It encircles the top of the beverage container and provides additional stability.

The objects and advantages of this invention will become apparent as the following description and accompanying drawings are considered.

BRIEF DESCRIPTION OF THE DRAWINGS

In order that the present invention may be clearly understood and readily practiced, preferred embodiments will now be described, by way of example only, with reference to the accompanying figures wherein.

DETAILED DESCRIPTION OF THE PREFERRED EMBODIMENTS

Figure 1:
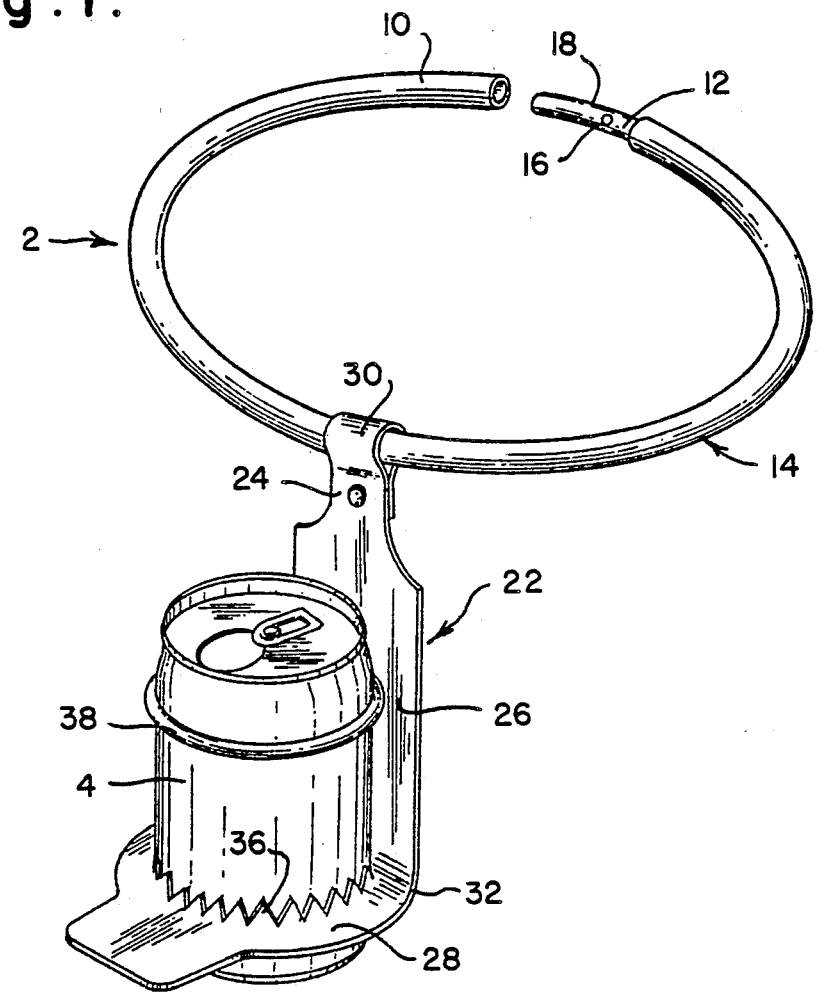
FIG. 1 is a perspective view of the apparatus for supporting a beverage container.
Figure 2:
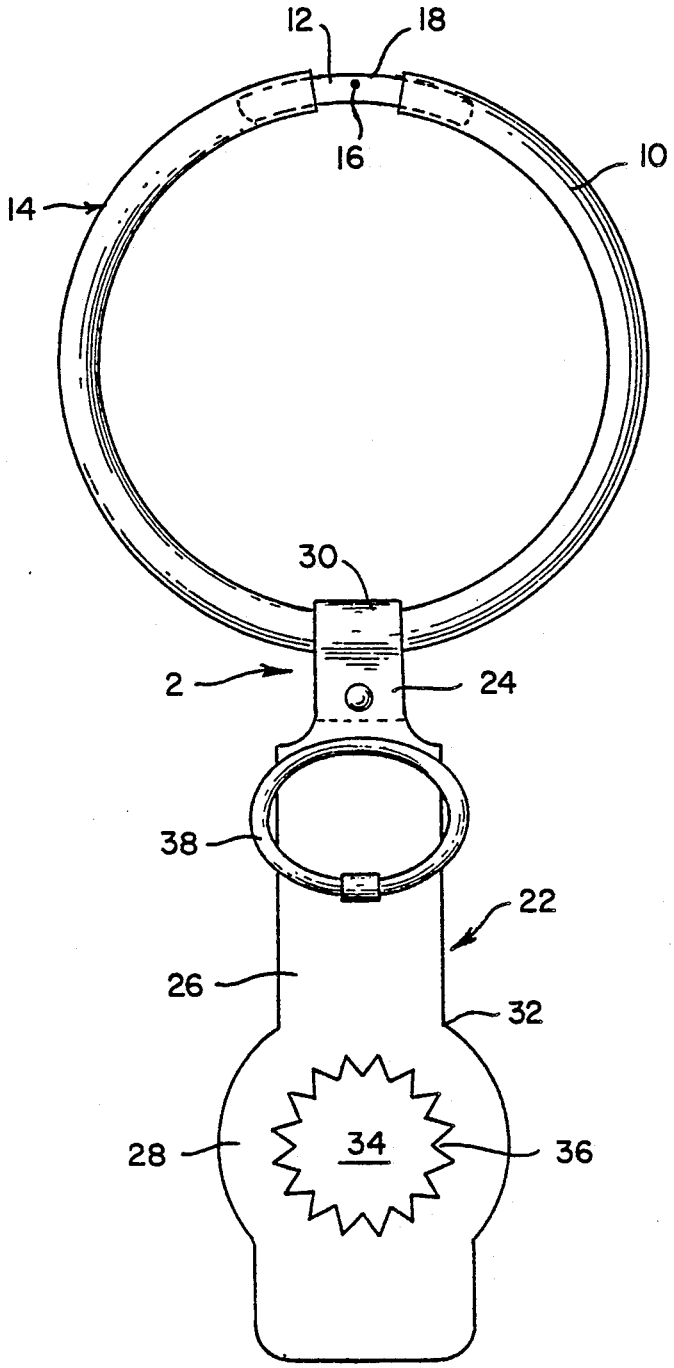
FIG. 2 is a top plan view of the support according to the present invention.
Figure 3:
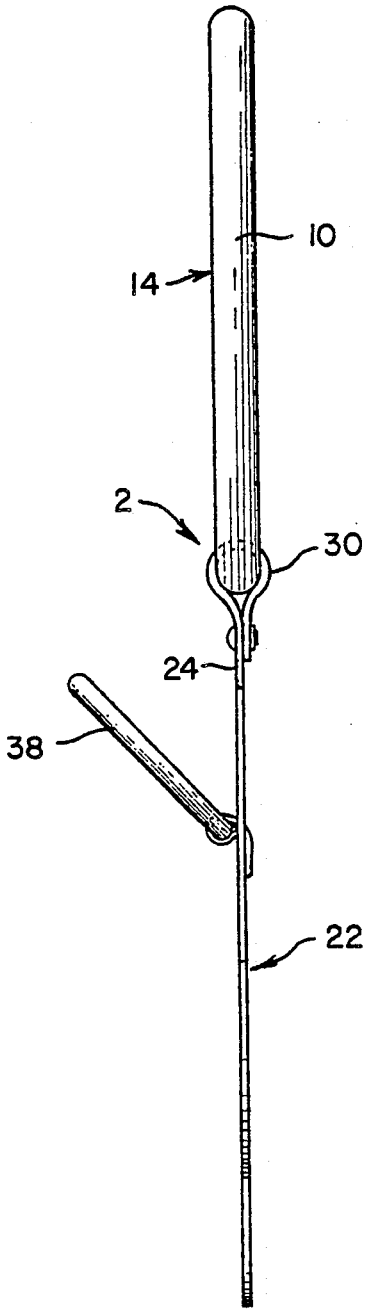
FIG. 3 is a side elevation view of the support according to this invention.

In accordance with the present invention, there is provided a support apparatus 2 for a container 4. While the container 4 is depicted herein as a cylindrical beverage container, it will be appreciated that the present invention may be modified by those skilled in the art to accommodate containers of alternative shapes. The support apparatus 2 includes a first length of semirigid hollow plastic tubing 10 and a smaller second length of similar tubing 12. As used herein, "semirigid" refers to tubing which may be bent into a circular shape but which will substantially retain such shape once formed into a ring. Both lengths of tubing 10 and 12 are open-ended and the outer diameter of second tubing 12 corresponds to the inner diameter of first tubing 10. As such, the ends of second tubing 12 may snugly fit into the open ends of tubing 10 to form a closed ring 14 which may encircle and be supported by the neck of a user.

Smaller tubing 12 is provided with a bore 16 midway along the length of its top surface 18. An identical bore (not shown) is similarly located along the bottom surface of tubing 12 such that the bores are aligned. After insertion of tubing 12 into tubing 10 to form the closed ring 14, the size of ring 14 is adjusted by sliding tubing 12 along the interior of tubing 10. When a slight force is applied to tubing 12, the air within the tubing is compressed and exits via the bores allowing for easy movement of second tubing 12 within first tubing 10.

A container support member 22 is provided which includes a narrowed end 24, a center portion 26, and a widened end 28 and which is made from a thin, flexible material such as plastic. The narrowed end 24 is placed around tubing 10 of ring 14 and fastened to itself by any well known means thereby forming a loop 30. The loop 30 is loose enough to permit freedom of movement of container support member 22 around the entire ring 14.

The remainder of the support member 22 is suspended from the ring by means of loop 30. Widened end 28 may be circular in shape and is bent at a 90° angle from center portion 26, so that end 28 is perpendicular to the suspended portion of the container support member 22. Such bending may be more readily accomplished by providing a cut on support member 22 on its reverse surface to thereby form a hinge 32. As such, the central portion 26 forms the first leg of a support member 22 while the widened end 28 forms the second leg thereof.

A hole 34 is provided in the widened end 28 which is surrounded by a series of inwardly projecting gripping means such as serrations 36. The diameter of hole 34 is slightly smaller than the diameter of the beverage container to be retained. Upon insertion of the container in hole 34, the hole 34 expands slightly due to the elasticity of the material and the serrations 36 grip the container 4 to securely hold it.

A stabilizing ring 38 made of flexible plastic tubing is fastened to the center portion 26 of the flap and is parallel to hole 34. Ring 38 encircles the top of the beverage container, serving as an additional means of support of the container 4.

The above described apparatus may be adapted to accommodate a variety of beverage containers, including baby bottles of various size, and standard size soft drink cans. When the soft drink can is being used, placement of a conventional drinking straw in the can allows a person of limited physical capability to easily drink from the can without using his hands. In another embodiment, the device is used to hold a baby bottle in such a way as to permit a developing child to drink from the bottle unattended. The bottle is suspended from the neck ring, so it can not be thrown to the ground, yet the child may guide the bottle to his mouth as he begins to use his hands.

It will be understood that various changes in the details, materials and arrangement of parts which have been herein described and illustrated in order to describe the nature of the invention may be made by those skilled in the art within the principle and scope of the invention as expressed in the appended claims.

What is claimed is:

1. An apparatus for supporting a beverage container on the person of a user in order that the user may imbibe the beverage, comprising:

a. a primary support member which may be supported on the person of the user, said primary support member comprising an arcuate portion;

b. a flexible container support member comprising:

(1) a first leg attached at one end thereof to said arcuate portion for rotation around and movement along said arcuate portion; and (2) a second leg attached to the other end of said first leg for movement relative thereto between one position which is substantially parallel to said first leg and another position which is substantially perpendicular to said first leg, said second leg including means for holding said container; and c. means for stabilizing said container, said means for stabilizing being attached to said first leg.

2. Apparatus for claim 1 in which said means for holding comprises a serrated hole within said second leg, the serrated edges thereof capable of holding the circumference of said container.

3. Apparatus of claim 1 in which said flexible support member comprises a unitary member having a hinge therein to define said first and second legs, said hinge being formed by providing an area of reduced thickness of said member so as to facilitate its bending.

4. Apparatus of claim 1 in which said stabilizing means comprises a secondary flexible ring movably attached to said first leg and capable of engaging the circumference of said container.

5. Apparatus for supporting a beverage container on the person of a user in order that the user may inbibe the beverage, comprising:

a. a primary support member which may be supported on the person of the user, said primary support member comprising an arcuate portion;

b. a flexible container support member mounted on said arcuate portion for rotation around and movement along said arcuate portion and to depend therefrom; said container support member including:

(1) a first portion proximal to said arcuate portion and adapted to rest on the chest of the user, and (2) a second portion distal from said arcuate portion and connected to said first portion for movement between one position which is substantially parallel to said first leg and another position which is substantially perpendicular to said first portion, said second portion having means for holding the beverage container in a substantially upright orientation.

6. Apparatus as recited in claim 5 wherein:

said means for holding said beverage container comprises means for frictionally engaging the peripheral surface of said container.

7. Apparatus as recited in claim 6 wherein:

said means for frictional engagement comprises an opening having an edge portion adapted to grip said container.

8. Apparatus as recited in claim 5 which further comprises:

means mounted on said first portion of said container support member for stabilizing said container in said substantially upright orientation.

* * * * *